US012325607B2

(12) United States Patent
Celeste et al.

(10) Patent No.: US 12,325,607 B2
(45) Date of Patent: Jun. 10, 2025

(54) DEVICE AND METHOD FOR FEEDING FLAT OBJECTS INTO A TRANSPORT CONTAINER

(71) Applicant: BÖWE SYSTEC GmbH, Augsburg (DE)

(72) Inventors: Ronald Celeste, Kühlenthal (DE); Joachim Koschier, Augsburg (DE)

(73) Assignee: BÖWE SYSTEC GmbH, Augsburg (DE)

( * ) Notice: Subject to any disclaimer, the term of this patent is extended or adjusted under 35 U.S.C. 154(b) by 119 days.

(21) Appl. No.: 18/132,501

(22) Filed: Apr. 10, 2023

(65) Prior Publication Data

US 2024/0336452 A1 Oct. 10, 2024

(51) Int. Cl.
*B65H 31/10* (2006.01)
*B65H 29/18* (2006.01)

(52) U.S. Cl.
CPC ..... *B65H 31/10* (2013.01); *B65H 29/18* (2013.01); *B65H 2301/4214* (2013.01); *B65H 2404/623* (2013.01); *B65H 2405/212* (2013.01); *B65H 2701/1916* (2013.01)

(58) Field of Classification Search
CPC ..... B65H 29/18; B65H 31/10; B65H 31/06; B65H 2301/422548; B65H 2701/1916; B65G 57/11
See application file for complete search history.

(56) References Cited

U.S. PATENT DOCUMENTS

| | | | |
|---|---|---|---|
| 4,019,730 | A | 4/1977 | Staudinger |
| 4,114,351 | A | 9/1978 | Morimoto |
| 4,273,491 | A | 6/1981 | Roux |
| 4,441,702 | A | 4/1984 | Nagel |
| 4,518,160 | A | 5/1985 | Lambrechts |
| 6,594,974 | B2 | 7/2003 | Theriault |

(Continued)

FOREIGN PATENT DOCUMENTS

| | | | |
|---|---|---|---|
| DE | 28 16 766 | A1 | 10/1978 |
| DE | 43 44 744 | A1 | 6/1995 |

(Continued)

OTHER PUBLICATIONS

Result of Examination Report for German Patent Application No. 10 2021 117 317.5, filed Jul. 5, 2021.

(Continued)

*Primary Examiner* — Jeremy R Severson
(74) *Attorney, Agent, or Firm* — Fleit Intellectual Property Law; Paul D. Bianco; Katharine Davis Wong

(57) ABSTRACT

A device and a method for feeding flat objects, in particular mail items such as envelopes or letters, in an upright position into a transport container. The device comprises a feed device for transporting flat objects and for feeding the transported flat objects into a transport container, and a container receiver for positioning the transport container during the feeding of the flat objects in a feed position in which the transport container is arranged obliquely. The device and the method enable to take full advantage of the capacity of the transport container by using a compression unit for compressing the flat objects fed into the transport container, in particular while the transport container is arranged in the input position.

20 Claims, 9 Drawing Sheets

(56) References Cited

U.S. PATENT DOCUMENTS

| | | | | |
|---|---|---|---|---|
| 2004/0098948 | A1 | 5/2004 | Caporali | |
| 2006/0180434 | A1 * | 8/2006 | Arnold | B07C 3/008 198/463.3 |
| 2024/0336451 | A1 | 10/2024 | Celeste | |

FOREIGN PATENT DOCUMENTS

| | | | |
|---|---|---|---|
| DE | 199 63 021 | A1 | 6/2001 |
| DE | 697 32 629 | T2 | 4/2006 |
| DE | 10 2016 207 157 | A1 | 11/2016 |
| DE | 202021103618 | U1 * | 11/2022 |
| EP | 0 049 718 | A1 | 4/1982 |
| EP | 3 441 150 | A1 | 2/2019 |
| JP | 2008 302 962 | A | 12/2008 |
| JP | 2018-136034 | A | 8/2018 |
| WO | 2012/075520 | A1 | 6/2012 |

OTHER PUBLICATIONS

Result of Examination Report for German Patent Application No. 10 2021 117 320.5, filed Jul. 5, 2021.
Office Action dated Feb. 29, 2024 for German Patent Application No. 10 2021 117 320.5.

* cited by examiner

Fig. 19
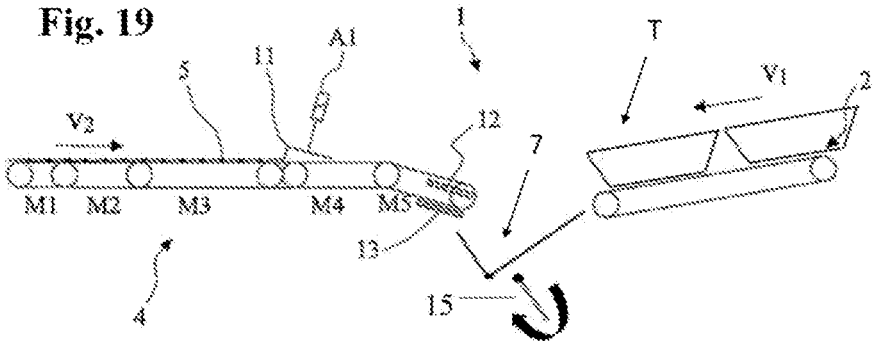
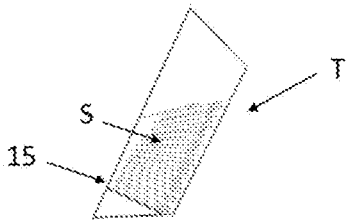
Fig. 20 A
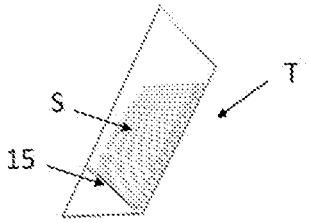
Fig. 20 B

DEVICE AND METHOD FOR FEEDING FLAT OBJECTS INTO A TRANSPORT CONTAINER

FIELD OF THE INVENTION

The invention relates to a device for feeding flat objects, in particular mail items such as envelopes or letters, in an upright or vertical position, respectively, into a transport container. The invention further relates to a method for feeding flat objects in an upright or vertical position, respectively, into a transport container.

Flat objects like mail items, in particular letters or envelopes, are normally fed into transport containers for further transport, for example after being produced in a printing device, after being inserted in an enveloping device or after being sorted in a sorting device. The objects inserted in a container are then passed on to a further processing point, e.g. a dispatch point for dispatching the mail items to the addresses indicated on the mail items. In order to improve the capacity of a transport container and to facilitate subsequent removal of the mail items, the mail items are preferably placed in the transport container in an upright position. A transport container is understood to be an upwardly open container with a bottom and side walls arranged on the bottom and surrounding it on all sides. Preferably, the transport container is a container with a substantially rectangular bottom and four side walls extending from the bottom. By an upright position of the flat objects or the input of the flat objects in an upright position is meant a position of the flat objects in which only a narrow edge of the flat objects, for example the elongated lower edge of an envelope, stands up on the bottom of a transport container. The flat object in an "upright position" thus projects upwards from the bottom of the transport container.

U.S. Pat. No. 6,594,974 B2 is disclosing a device for packaging folded shipping packages in sheet form. The packages are moved by a feed device in the direction of a box which is guided at an angle to the feed device and the packages are fed into the box in an upright position. For transporting and positioning the box, a conveyor device is provided in which boxes are preferably manually fed in on an upper side and guided down along an incline and past the feed device. After filling, the boxes are diverted from the fixed incline to a discharge conveyor via a movable contact element resting against the box. For this purpose, the movable contact element rests against the front wall of the box. The contact element supports the box by resting against the front wall during transport of the box along the incline and the associated increasing departure from the incline. As soon as the rear edge of the box has left the incline, the box rotates due to gravity and falls onto the discharge conveyor provided for transporting the box away.

SUMMARY

It is an object of the present invention to provide a device and a method for the insertion of flat objects, in particular mail items, in an upright position into a transport container, in which the storage capacity of the transport container can be optimally utilized.

The invention solves the above mentioned object with an apparatus as disclosed herein and by a method as disclosed herein. Advantageous embodiments and useful embodiments of the invention are also disclosed herein.

The device according to the invention for feeding flat objects, in particular mail items such as envelopes or letters, in an upright position into a transport container, (thus an empty transport container or a transport container to be filled), comprises a input device for transporting a plurality of flat objects and for feeding the transported flat objects into a transport container, and a container receiving means for positioning the transport container for the feeding of the flat objects in an input position in which the transport container is arranged obliquely with respect to a horizontal plane. Therein, the input device is preferably configured for serially transporting a plurality of the flat objects along a transport direction lying at least substantially in a horizontal plane, wherein the plurality of the flat objects is transported in a singled or a shingled arrangement.

Further, the container receiving means is part of a receiving device and is preferably configured for at least partially or completely receiving a transport container, in particular for securely arranging the transport container in the container receiving means during the input of the flat objects. In particular, the container receiving means can be designed in such a way that it can receive an empty transport container from a first transport device designed for transporting transport containers and can deliver a filled transport container, after filling by the input device with a plurality of flat objects, to a second transport device designed for transporting filled transport containers.

The oblique arrangement of the transport container in the input position is to be understood as an arrangement in which the bottom of the transport container encloses an angle with the horizontal plane which is smaller than 90° but preferably larger than 30°. Accordingly, also an open top of the transport container that is opposite to the bottom, is directing towards the input device, when the transport container is in the input position. Consequently, the open top of the transport container does not point substantially upwards in the input position, but to one side, namely in the direction of the input device. Particularly, the bottom of the transport container in the input position encloses with the horizontal plane an angle which is smaller than 90°, and preferably is between 45° and 85°, particularly between 60° and 80°. The described embodiment provides an advantageous input of the flat objects in an upright position into the transport container.

According to the invention, the device comprises a compression unit for compressing a stack of flat objects fed into the transport container, in particular for compressing the stack of flat objects obtained by the stacking of a plurality of flat objects inside the transport container, while the transport container is arranged in the input position. By compressing the stack of flat objects produced in the transport container by feeding a plurality of flat objects into the transport container, the filling capacity of the transport container can be fully utilized in an optimized manner. The number of flat objects that can be fed into a transport container with a given filling capacity can thus be increased by the compression of the stack of flat objects by use of the compression unit.

In an advantageous embodiment, the at least one compression unit is comprising a compression element, in particular a compression finger or a compression pin, that can be inserted into the transport container during and/or after the input of the flat objects. Specifically, a compression element that can be inserted into the transport container during the input compresses the stack of flat objects that has already been developed in the transport container, thereby creating more space for additional objects to be input on top of the stack. In order to be able to optimize the storage of the plurality of flat objects in the transport container, it is advantageous to design the compression element to be as thin as possible.

In a particularly preferred embodiment, the compression element can be moved between an upper position and a lower position. When the compression element is moved into the transport container, the compression element presses the stack of flat objects that has already been inserted downwards against the front side wall of the transport container (or the lower side wall as seen from the input position). This compresses the flat objects that have already been stacked into the transport container.

After compression, the compression element preferably remains in the transport container on top of the stack during further feeding of a plurality of further objects, which are placed one after the other on top of the stack. The subsequent objects are therefore inserted above the compression element. It is also conceivable that the compression element is extended from the transport container after a first compression has taken place and is retracted into the transport container for renewed compression at a later time and after further flat objects have been inserted. Alternatively, it is also possible to provide several compression units, each comprising a compression element, which are inserted one after the other into the transport container on top of a stack of flat objects produced therein by serially feeding a plurality of flat objects, wherein each of the compression elements is used for compression of the stack of flat objects which is already stacked in the transport container until insertion of the respective compression element. In this way, the storage capacity of the transport container can be better utilized and the number of flat objects which can be stacked in the transport can be optimized.

In a preferred embodiment, each compression unit may comprise a drive for moving the compression element, in particular for moving the compression element into and also out of the transport container and/or between an upper position and a lower position inside the transport container. By means of the drive, a fast and safe insertion and removal of the compression element as well as a movement between the upper and the lower position of the compression element for compressing the stack of flat objects inserted in the transport container can be effected.

In addition, or alternatively to the described advantageous design, the container receiving means together with the transport container arranged therein can be designed to be movable between an upper input position and a lower input position of the container receiving means. The movement of the container receiving means is preferably carried out by a moving device of a receiving device comprising the container receiving means. In a preferred embodiment, the angle of the container receiving means or of a transport container arranged therein relative to the vertical direction is not changed during the movement of the container receiving means from the upper to the lower input position. In another embodiment, the container receiving means may be pivoted relative to the input device, particularly toward or possibly away from the input device, during movement from the upper to the lower input position to achieve a desired and optimized angle for input of the flat objects. By moving the transport container from the upper to the lower input position, an advantageous and trouble-free input of the flat objects in an upright position into the transport container is given, wherein in particular the subsequently input flat objects each rest on top of the stack of flat objects which has been already input into the container before. The movement of the container receiving means from the upper to the lower input position preferably takes place as a function of the input flow of the flat objects transported serially by the input device towards the transport container. Advantageously, the movement of the container receiving means takes place as a function of the conveying speed with which the flat objects are serially moved by the input device in the direction of the transport container and are input therein. The movement of the container receiving means can also be performed upon the number and/or thickness of the flat objects to be input into the transport container.

In a particularly advantageous embodiment, a sensor can also be provided that detects the filling level of the transport container and controls the movement of the container receiving means from the upper to the lower input position as a function of the detected filling level. In addition to the aforementioned advantages for the input, a compression element of the compression unit inserted into the transport container and an upward movement of the container receiving means can also compress the stack of flat objects that has already been input. The top of the stack of flat objects that has already been inserted rests against the inserted compression element and is pressed against the lower side wall of the transport container (as seen from the input position). A movement of the compression element between an upper position and a lower position for compressing the flat objects inserted into the transport container is not absolutely necessary. However, it is also conceivable that both, a downward movement of the compression element and an upward movement of the container receiving means together with the transport container takes place for compressing the stack of flat objects inserted into the transport container. In particular, in an advantageous embodiment, the compression element can be moved downwards together or synchronously with the container receiving means after compression has taken place. In this way, a compression state of the compressed stack of flat objects inserted into the transport container is maintained until the end of the serial insertion of flat objects by the insertion device.

In a preferred embodiment, the at least one compression unit may be arranged on or at the input device and/or on or at a receiving device comprising the container receiving means. Particularly preferably, the device has at least two compression units, comprising a first compression unit being arranged on or at the input device and a second compression unit being arranged on or at a receiving device comprising the container receiving means.

For compression, the first compression element can be moved into the transport container and above a stack of flat objects inserted therein by a drive. The stack of flat objects in the transport container thereby can preferably be compressed when the first compression element is extended by moving the container receiving means together with the transport container arranged therein upwards. The stack of flat objects already inserted in the transport container is thereby pressed against the stationary first compression element, whereby compression of the flat objects stacked in the transport container takes place. As soon as a certain compression position has been reached, the second compression element, which is preferably fixed to the receiving device and moves up and down in particular together with the container receiving means, can be introduced into the transport container and on top of the stack of flat objects. In this case, the first and the second compression elements are designed and arranged in such a way that they do not interfere with each other, in particular also not when the second compression element moves upwards and downwards together with the container receiving means. The defined compression position is specifically reached when the second compression element is at the same height level as the first compression element. When this defined compression position is reached, the second compression element is inserted into the transport container on top of the stack. The first compression element can then be ejected from the transport container, in particular before the transport container is moved downwards. The following flat objects are subsequently deposited on the second compression element, which is moved downwards together with the transport container during further filling of the container. The second compression element will remain in the transport container and on top of the initial stack until the container is completely filled with a plurality of flat objects and can be moved out of the transport container, for example, before the container receiving means is moved into a delivery position for discharging the filled transport container. It is also conceivable that the first compression element is reintroduced into the transport container for further compression and/or that the receiving device comprises a plurality of compressing units with each compression unit having a compression element, wherein the several compression elements can be inserted subsequently at different times into the transport container on top of a stack of flat objects stacked therein.

In an advantageous embodiment, in the input position the input device engages at least partially in a transport container arranged in the container receiving means. Particularly preferably, the input device has an input end that engages into the transport container during the entire input process. This ensures safe inputting and depositing of the flat objects in a transport container in an upright position.

In an advantageous embodiment, the input device comprises a conveyor device, in particular a number of conveyor rollers and/or at least one conveyor belt, for transporting the flat objects in an shingled and/or singled arrangement. In a shingled arrangement, the flat objects lie at least partially one above the other. Preferably, the flat objects lie on the conveyor rollers and/or the at least one conveyor belt, in particular an endless conveyor belt, wherein the conveyor rollers and/or the at least one conveyor belt can be driven by a motor for transporting the flat objects in a second transport direction. The described embodiment provides an input device with a particularly simple and safe transport of the flat objects along the second transport direction. By controlling the drive or the speed of the conveyor device, the input speed of the flat objects into the transport container can be controlled and regulated.

In a particularly advantageous embodiment, the input device has at least two conveyor sections, preferably at least three, especially preferably at least four, and most preferably at least five consecutive conveyor sections, which can be operated or driven independently of one another and in particular at different speeds. This enables, among other advantages, a brief and controlled deceleration or interruption of the input stream of flat objects from an uninterrupted flow of flat objects to be introduced.

In a particularly advantageous embodiment, the input device has at least one restraining element, wherein a restraining element in particular is arranged between two consecutive conveyor sections of the conveyor device of the input device. The restraining element can also insertable between two consecutive conveyor sections of the conveyor device. In this case, the restraining element serves for at least briefly restraining and/or scaling up the series of flat objects transported by the input device. In a particularly preferred embodiment, the restraining element is a restraining element extending transversely to the first transport direction, for example in the form of a restraining plate or a restraining bar. The restraining element can also be designed as a rake. Expediently, the restraining element is moved towards a conveying surface of the conveying device by an actuator or a drive unit for restraining or scaling up the input stream of flat objects. In a particularly preferred embodiment, the restraining element is moved from above towards the conveying surface of the the conveying device, in particular to the surface of a transport element. The restraining element can be moved from above between two consecutive conveying sections of the input device. In an alternative embodiment, the retaining element can also be arranged in the space between two consecutive conveyor sections and can be introduced from below upwards to interrupt the input flow of flat objects for retaining the flat objects.

In an advantageous embodiment, the container receiving means has a receiving base, on which the bottom of a transport container can be arranged, and at least one lower contact wall, on which a first side wall of a transport container can be arranged. The lower contact wall is preferably a contact wall connected to the receiving base at a fixed angle. In a preferred embodiment, the lower contact wall is rigidly connected to the receiving base. In a particularly advantageous embodiment, the container receiving means has at least two lateral contact walls for guiding side walls of the transport container. The described embodiment provides secure guidance of the transport container during the entire process. In addition or as an alternative to the described embodiment, the container receiving means can have a suction device arranged on the receptacle base and, is controllable, by means of which the bottom of a transport container can be sucked in and the transport container can be fixed or held in the container receiving means during the insertion of the flat objects into the container. The suction device can be designed, for example, as a squeegee or it can comprise several suction cups arranged in the receiving base and connected to a vacuum pump.

Further, the invention comprises a method for feeding flat objects, in particular mail items such as envelopes or letters, in an upright position into a transport container with an apparatus described above, wherein the method is comprising:

Input of flat objects by the input device into a transport container arranged in the container receiving means in the input position, compressing a stack of flat objects introduced into the transport container by at least one compression element, wherein the at least one compression element is moved into the transport container during or after the introduction of the flat objects and is moved from an upper position to a lower position of the compression element and/or the container receiving means with a transport container arranged therein is moved from a lower position to an upper position of the container receiving means, wherein the stack of flat objects is compressed by the movement of the compression member from the upper position to the lower position of the compression member or by the movement of the container receiving means from the upper position to the lower position of the container receiving means.

In a particularly preferred embodiment, the method further comprises a step of removing the compression element from the transport container after a certain filling level of the transport container has been reached, i.e. in particular after a transport container has been filled completely with a plurality of flat objects.

In an advantageous embodiment, the method further comprises a step of moving the container receiving means together with a transport container arranged therein from an upper input position to a lower input position. The step of moving the container receiving means can take place in particular before and/or after the step of compressing. This enables the flat objects to be entered on top of the stack of flat objects already inserted in the transport container in an advantageous manner.

A particularly preferred embodiment of the method is performed with a device having at least a first compression unit with a first compression element and a second compression unit with a second compression element, wherein, in particular, the first compression unit is arranged on or at the input device and the second compression unit is arranged on or at a receiving device comprising the container receiving means. In this preferred embodiment, the step of compressing the stack of flat objects inserted into the transport container further comprises the following substeps:

- Insertion of the first compression element into the transport container above the stack of flat objects;
- Moving the container receiving means upwards, thereby compressing the stack of flat objects;
- Insertion of the second compression element, in particular on top of the compressed stack of flat objects;
- Removing the first compression element from the transport container, while the second compression element rests on the compressed stack of flat objects;
- Removing of the second compression element from the transport container, when a certain filling level of the transport container is reached.

Therein, after insertion of the second compression element, the flat objects which are feeded subsequently into the transport container, are placed on the second compression element.

In a preferred embodiment, before the step of inputting flat objects by the input device, the container receiving means can receive an empty transport container transported by a first transport device, and the container receiving means can deliver a transport container to a second transport device after it has been filled with a plurality of flat objects. Therein, the second transport device can be arranged below the first transport device and the container receiving means can be designed to be swiveled between a receiving position for receiving an empty container, an input position for filling the container with a plurality of flat objects and a delivery position for discharging a container filled with a plurality of flat objects.

The methods described enable a transport container to be filled with a plurality of flat objects while making advantageous use of the transport container's receiving quota.

BRIEF DESCRIPTION OF THE DRAWINGS

These and further features as well as advantages and technical effects of the device and the method according to the invention are disclosed in the following embodiments described in more detail with reference to the accompanying drawings. The drawings show:

FIG. 19: Schematic illustration of a further embodiment of the device with a base element that can be inserted by a pivoting movement into a transport container located in an input position in the device;

FIGS. 20A and 20B: Schematic representation of a transport container in an input position in the device, with a base element located in the transport container and a stack of flat objects arranged on the base element, wherein the base element can be tilted relative to a horizontal plane and is shown in FIGS. 20A and 20B in two different tilting positions.

DETAILED DESCRIPTION

Figure 1:
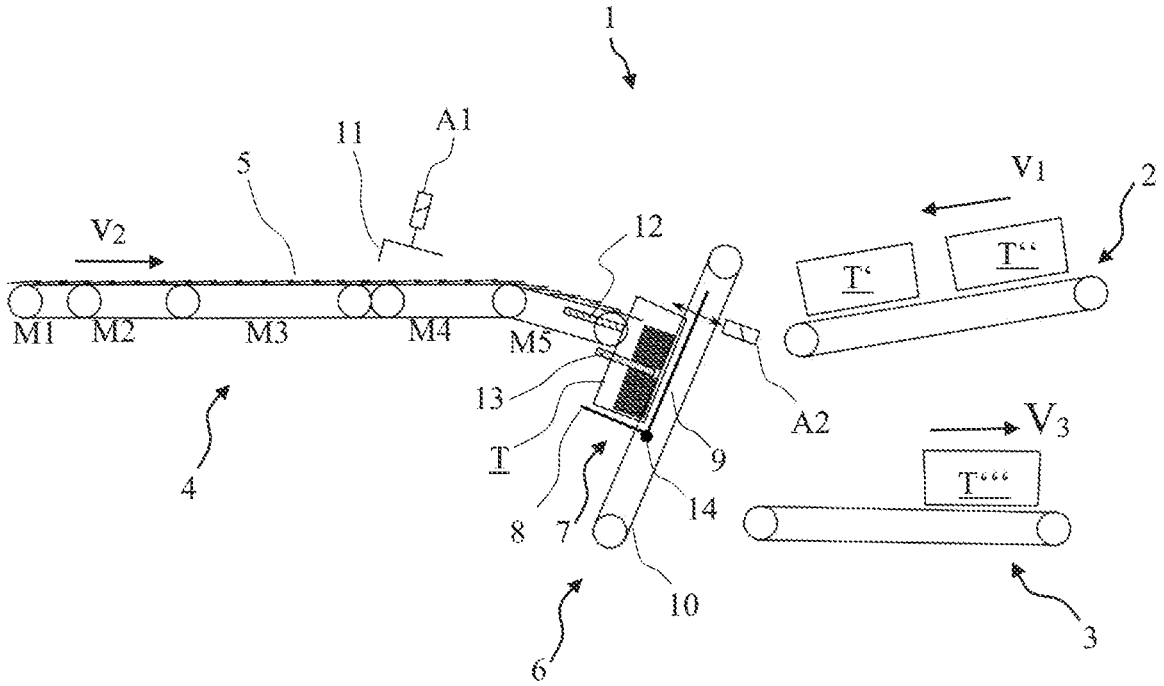
FIG. 1: Sketch of a device for feeding flat objects into a transport container in a side view.

FIG. 1 shows an exemplary sketch of a device 1 according to the invention for feeding flat objects 5 in an upright position into a transport container T. FIGS. 2 to 16 show reduced sketches of the device from FIG. 1 in individual and consecutive process steps of a method according to the invention for feeding the flat objects 5 into the transport container T, whereby individual components of the device 1 have been omitted in FIGS. 2 to 16 merely for the sake of clarity.

The device 1 for feeding flat objects 5 outlined in FIG. 1 comprises a first transport device 2 for transporting transport containers T along a first transport direction v1, an input device 4 for transporting flat objects 5 along a second transport direction v2 essentially opposite to the first transport direction v1, and a second transport device 3 arranged below the first transport device 2 for transporting transport containers T in a third transport direction v3 running essentially parallel to the second transport direction v2. A receiving device 6 with a container receiving means 7 for receiving a transport container T is arranged between the input device 4 and the transport devices 2, 3.

The first and second transport devices 2, 3 each comprise a motor-driven conveyor device, in particular an endless conveyor belt, on which transport containers T can be transported along the first transport direction v1 and the second transport direction v2, respectively, in a substantially upright transport container position.

Viewed in the second transport direction v2, the input device 4 has several conveyor sections arranged one behind the other, namely a first conveyor section M1, a second conveyor section M2, a third conveyor section M3, a fourth conveyor section M4 and a fifth conveyor section M5. The conveyor sections M1 to M5, which in particular can each comprise endless conveyor belts rotating around driving and deflection rollers, can be driven independently of one another. Via the first conveyor section M1, the flat objects 5 are fed towards the input device 4, in particular from an infeed system (not shown here) connected upstream of the input device 4. Through the downstream fifth conveying section M5, the flat objects 5 are fed into a transport container T arranged in the container receiving means 7. In the present embodiment example, the first to fourth conveying sections M1 to M4 run essentially in a horizontal plane. The fifth conveying section M5 is slightly inclined downward. This favors an input of the flat objects 5 into a transport container T. In the region of the fifth conveying section M5, a first compression element 12 movable substantially along the second conveying direction v2 and insertable into a transport container T arranged in the container receiving means 7 is provided. The first compression element 12 is coupled to a drive (not shown) for performing a movement towards a transport container T placed in the container receiving means 7. Further, the input device 4 has a retaining element 11 arranged above the fourth conveying section M4, which can be brought in and out of engagement (e.g. by an up and down movement) by a first actuator A1 between the third and the fourth conveying sections M3, M4.

The container receiving means 7 of the receiving device 6 has at least one lower contact wall 8 and a receiving base 9, wherein a transport container T inserted into the container receiving means 7 rests with a front side wall against the contact wall 8 and rests with its bottom on the receiving base 9. Preferably, the container receiving means 7 has lateral contact walls, not shown in FIG. 1, for a secure lateral guiding of the transport container T. Via a second actuator A2, the container receiving means 7 can be rotated or pivoted about a pivot axis 14. In an alternative embodiment, it is also conceivable that the entire receiving device 6 is designed to be pivotable, i.e. that further components of the receiving device 6 are also pivoted together with the container receiving means 7.

Via a movement device 10, the container receiving means 7 can be moved between an upper position described in more detail below and a lower position. Further, the receiving device 6 comprises a second compression element 13 which can be inserted into a transport container T arranged in the container receiving device 7. The second compression element 13 is mounted in such a way that it is moved together with the container receiving means 7, in particular during an upward and downward movement, by the movement device 10. In an alternative embodiment not shown here, it is also conceivable that the second compression element 13 is attached to the receiving device 6 in such a way that it is also pivoted together with the container receiving means 7 when the latter is pivoted.

In the following, considering FIGS. 2 to 16, an example of a method according to the invention for feeding the flat objects 5 into the transport container T is described. The method outlined in FIGS. 2 to 16 is carried out in the device 1 of FIG. 1. However, the method according to the invention is not limited to the described embodiment and, in particular, need not to be executed in a device according to FIG. 1. Merely for the sake of clarity, the movement element 10 and the second actuator A2 in FIGS. 2 to 16 as well as the reference signs of the receiving device 6, the contact wall 8, the receiving base 9 and the pivot point 14 are not drawn in FIGS. 2 to 16.

Figure 2:
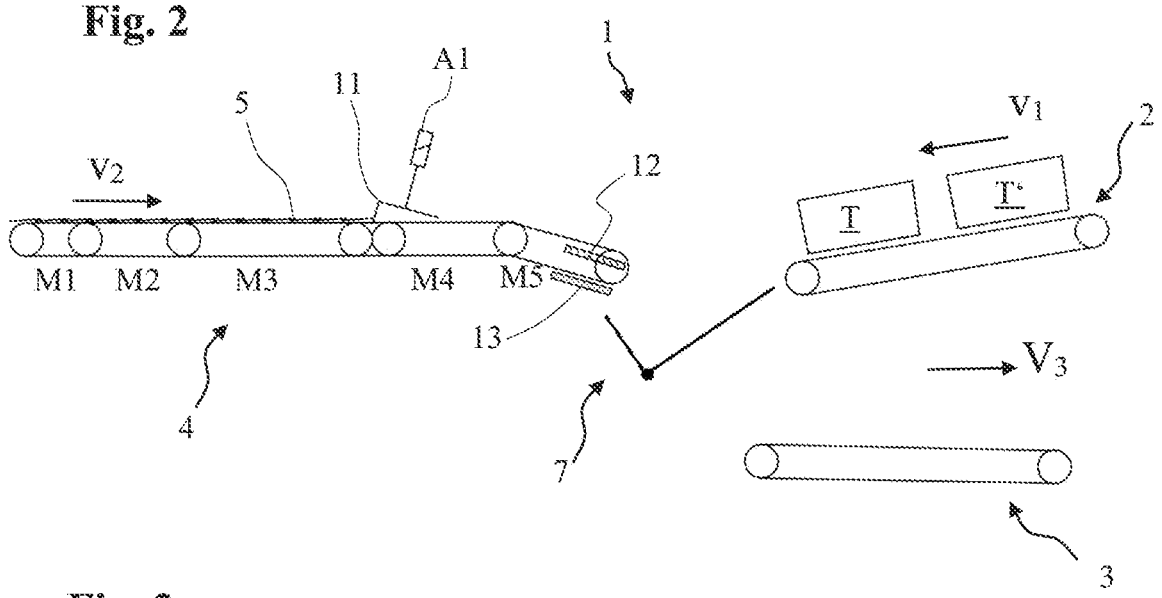
FIGS. 2 to 16: Sketches of the device of FIG. 1 in different process stages of a method for feeding flat objects into a transport container.
Figure 3:
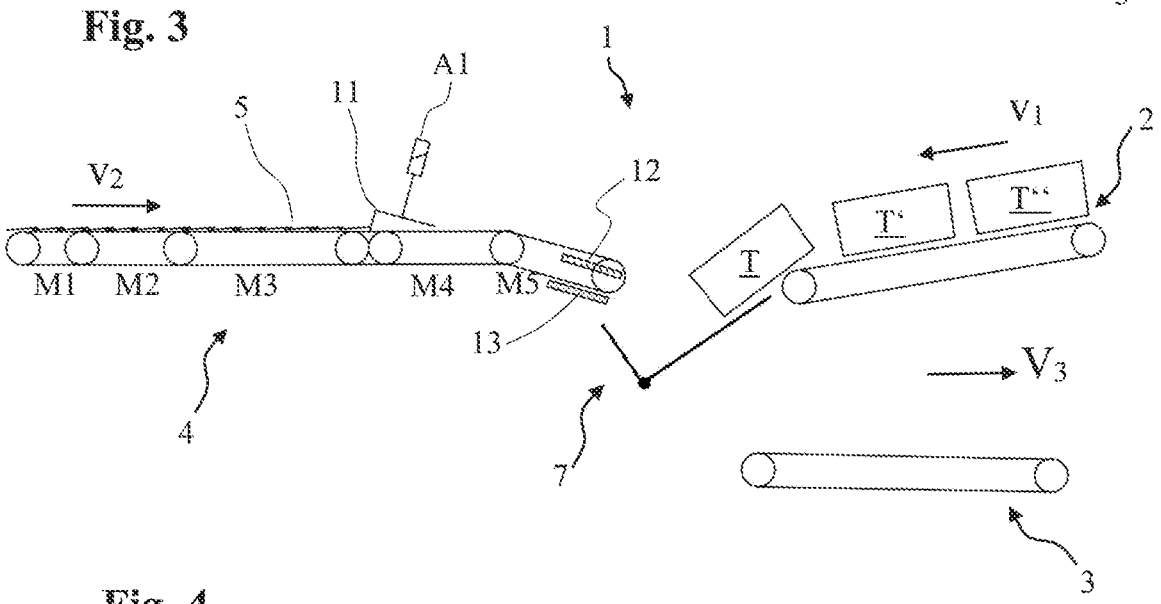

FIG. 2 and FIG. 3 show the transport of a transport container T by the first transport device 2 along the first transport direction v1 and the transfer of the transport container T into the container receiving means 7. For this purpose, the container receiving means 7 is moved to a receiving position shown in FIG. 2 and FIG. 3 for receiving the transport container T provided by the first transport device 2. When the container receiving means 7 is in the receiving position, the first transport device 2 is driven and the transport container T is conveyed along the first transport direction v1 into the container receiving means 7. Subsequent transport containers T', T" are already located in series on the first transport device 2. In the present case, however, the first transport device 2 is driven only during the transfer of the front transport container T and is then stopped until the next transport container T' shall be transferred to the container receiving means 7. In addition to the design shown, other designs of the first transport device 2 are also conceivable, for example a transport of transport containers T in the first transport device 2 using gravity alone and the provision of a limiting element at the end of the first transport device 2 pointing in the direction of the container receiving means 7, which can be introduced in front of one of the following transport containers T', T" in order to retain the following transport containers T', T" and which can be released for the transfer of the next transport container T' to the container receiving means 7, in order to allow a movement of the next transport container T' in the first transport direction v1.

Figure 4:
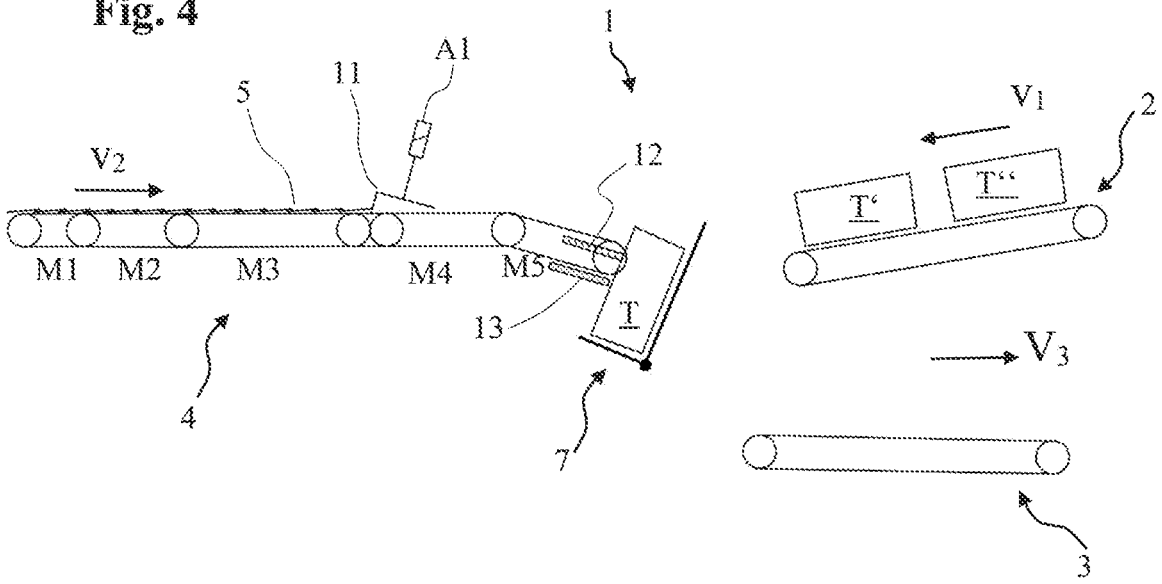
Figure 5:
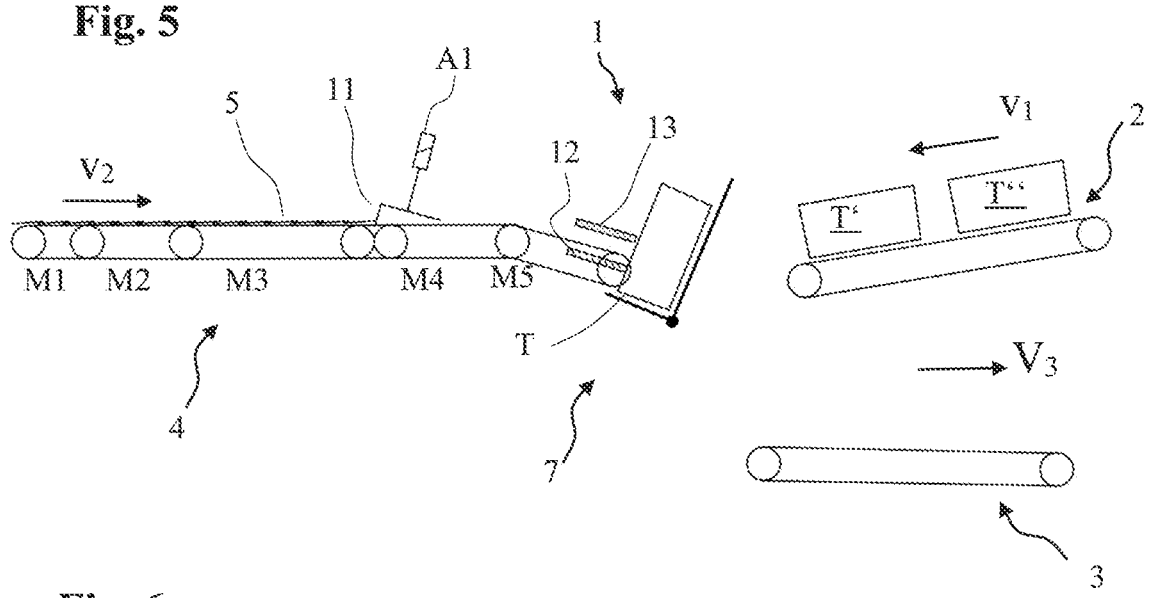

FIG. 4 and FIG. 5 show the movement of the container receiving means 7 from the receiving position shown in FIG. 2 and FIG. 3 to the upper input position shown in FIG. 5. For this purpose, the container receiving means 7 is first pivoted towards the input device 4, as shown in FIG. 4, and then moved upward by the movement device 10 shown in FIG. 1. As shown in FIG. 4 and FIG. 5, when the container receiving means 7 is moved to the upper input position shown in FIG. 5, the second compression element 13 attached to the receiving device 6 moves upwardly together with the container receiving means 7. The first and the second compression elements 12, 13 are configured and arranged in such a way that they do not interfere with each other, in particular not during an upward and downward movement of the container receiving device 7. For example, the compression elements 12, 13 can comprise compressing pins or compressing fingers arranged one behind the other.

As can be seen from FIGS. 2 to 5, while the transport container T is being picked up by the first transport device 2 and the container receiving means 7 is positioned in the upper input position, the retaining element 11 is in a lower position and thereby is blocking the conveyance of flat objects 5 by the input device 4 towards the container receiving means 7.

Figure 6:
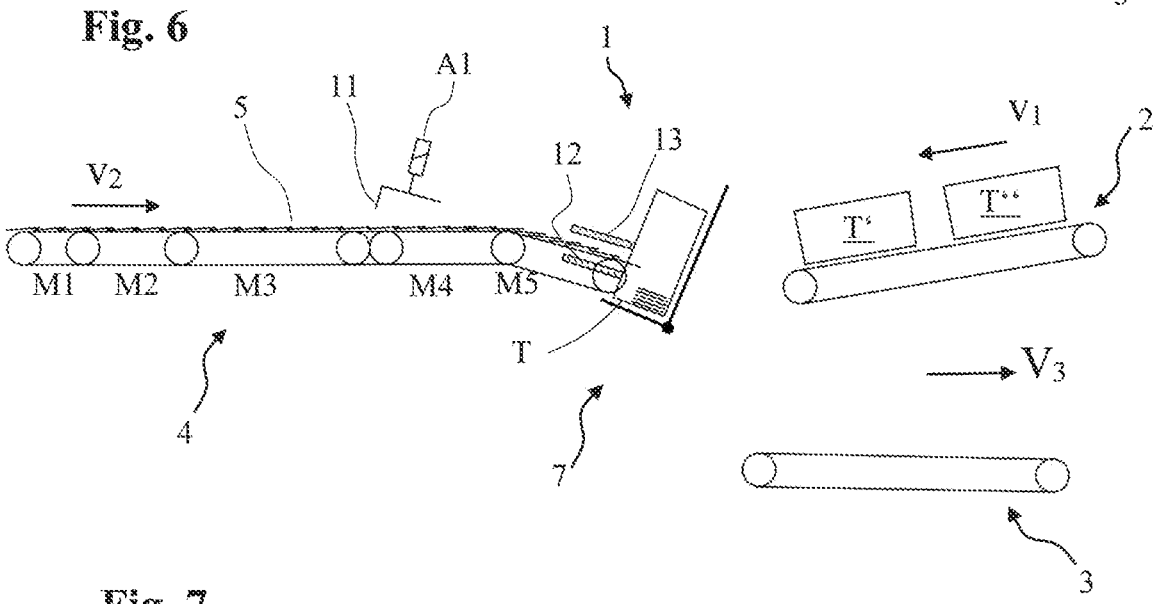

As shown in FIG. 6, when the container receiving means (and the transport container T contained therein) is in the upper input position, the retaining element 11 is moved upward by the first actuator A1 to a release position and the series of flat objects 5 is moved by the conveying sections M1 to M5 of the conveying device in the second transport direction v2 and is finally feeded into the transport container T via the fifth conveying section M5. The conveying sections M1 to M5 are thereby preferably all driven at the same conveying speed. The flat objects 5 are thus conveyed serially into the transport container T and stacked flat on top of each other in the transport container T to produce a stack S of flat objects therein, as can be seen in FIGS. 6 and 7.

Figure 7:
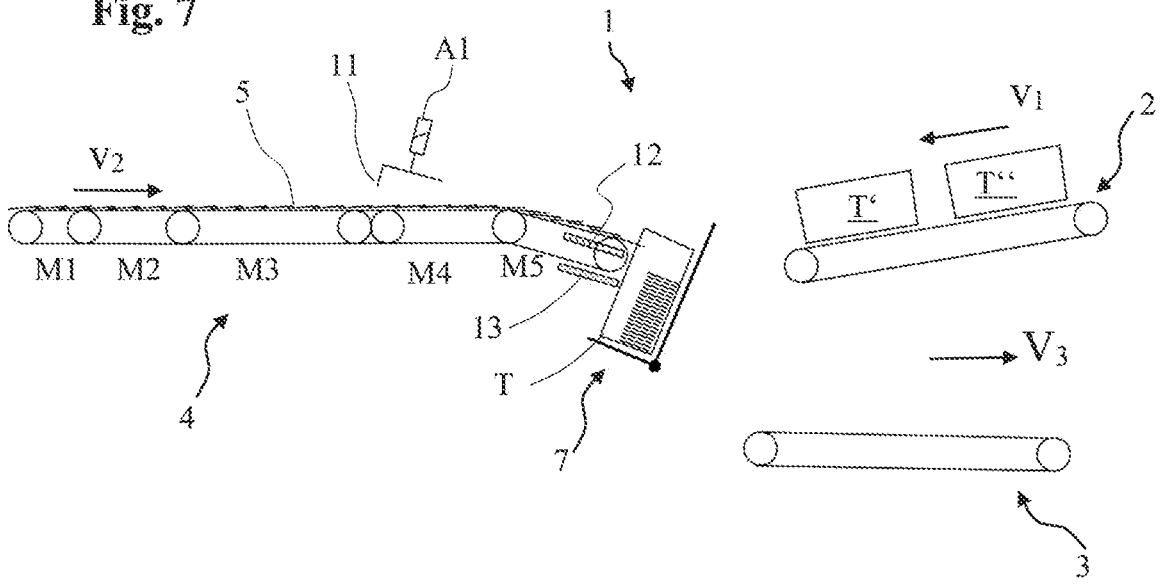

As the filling level of the transport container T increases, the container receiving means 7 is moved downward in steps or continuously, as shown in FIG. 7, to ensure a compact input of the plurality of flat objects 5, in particular a compact stacking of the flat objects 5 on the stack S of flat objects 5 developing inside the transport container T.

Figure 8:
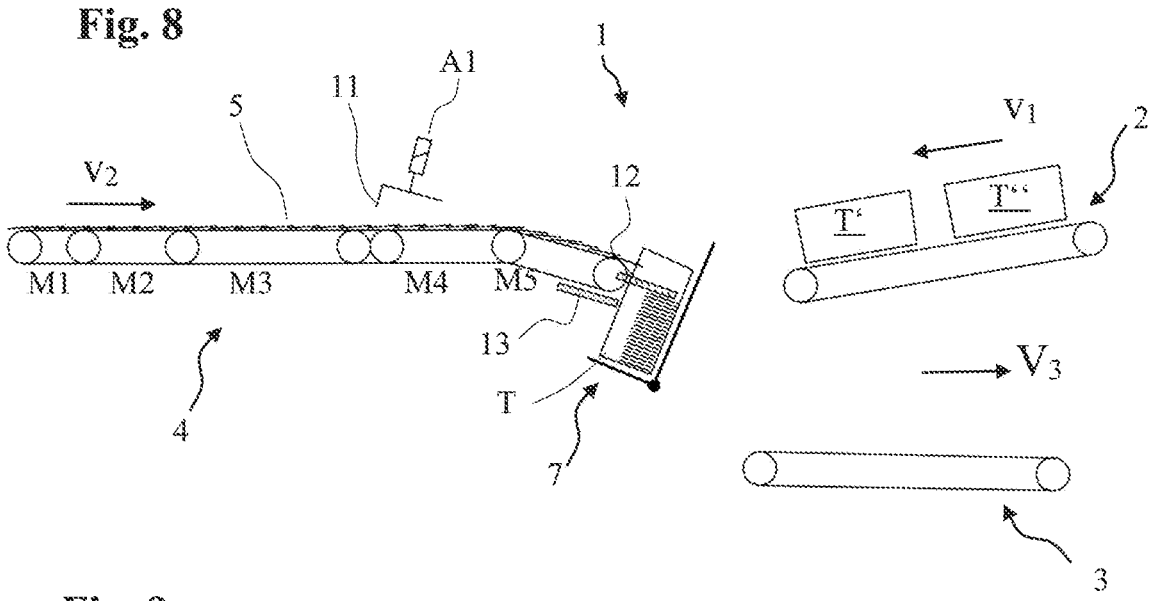

As soon as a certain filling level of the container T is reached, the first compression element 12 arranged on the input device 4 is moved into the transport container T, as shown in FIG. 8. For this purpose, the first compression element 12 is coupled to a drive element that is not shown here.

Figure 9:
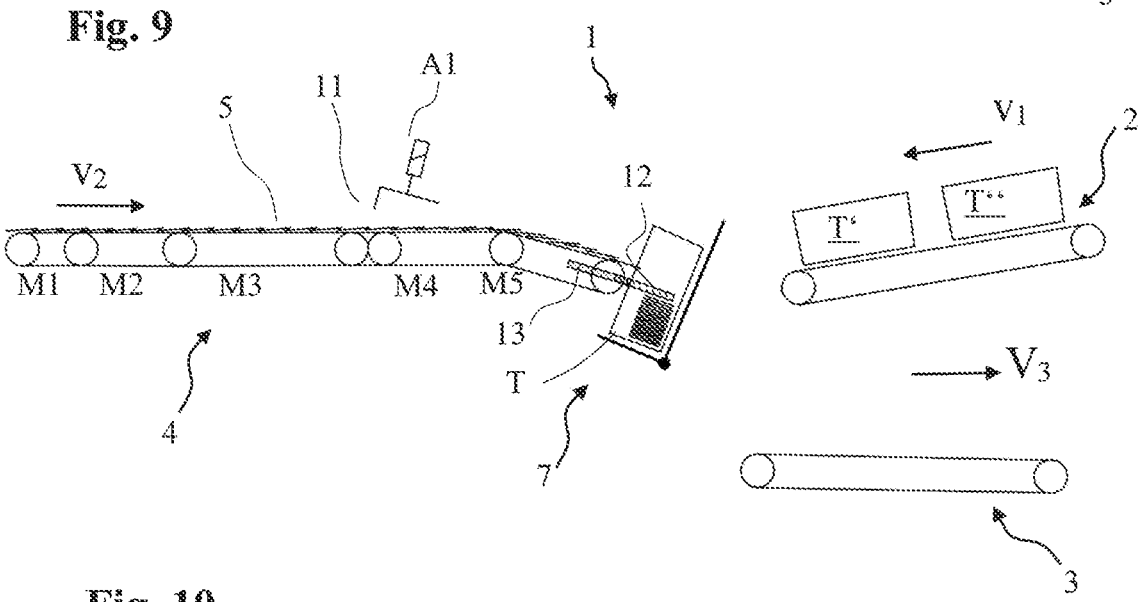

Subsequently, as shown in FIG. 9, a compression of the stack S of flat objects 5 placed in the transport container T takes place by moving the container receiving means 7 upward by means of the movement device 10 (shown in FIG. 1). Here, the compression of the stack S is achieved by pressing the flat objects 5 in the transport container T against the stationary first compression element 12 arranged on the input device 4. As soon as a certain level of compression is reached, at which in particular the second compression element 13 is at the same height level as the first compression element 12, the movement of the container receiving means 7 is stopped.

Figure 10:
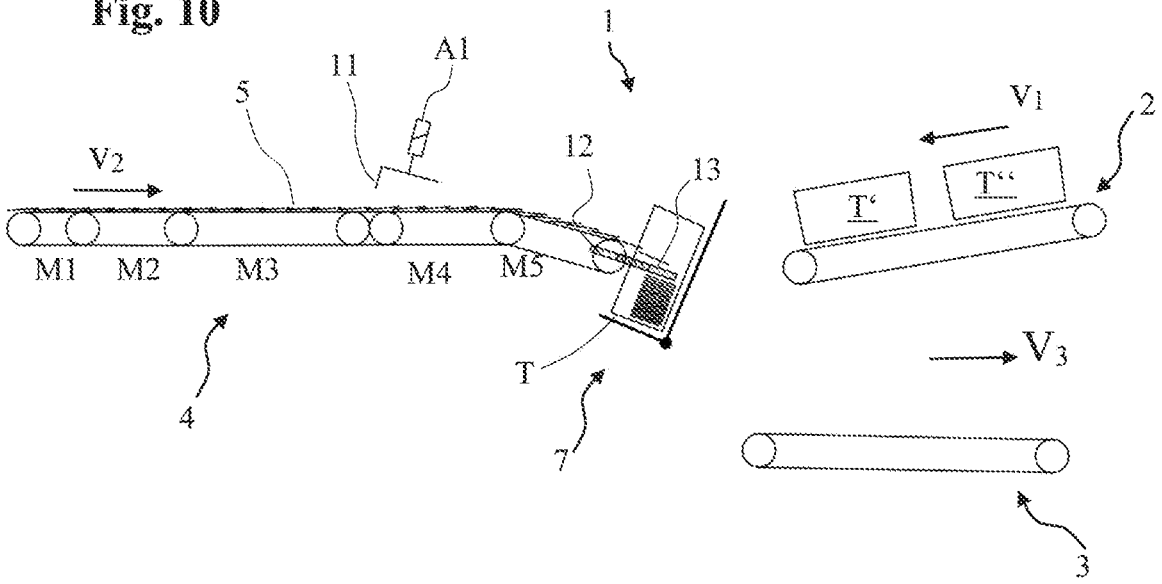
Figure 11:
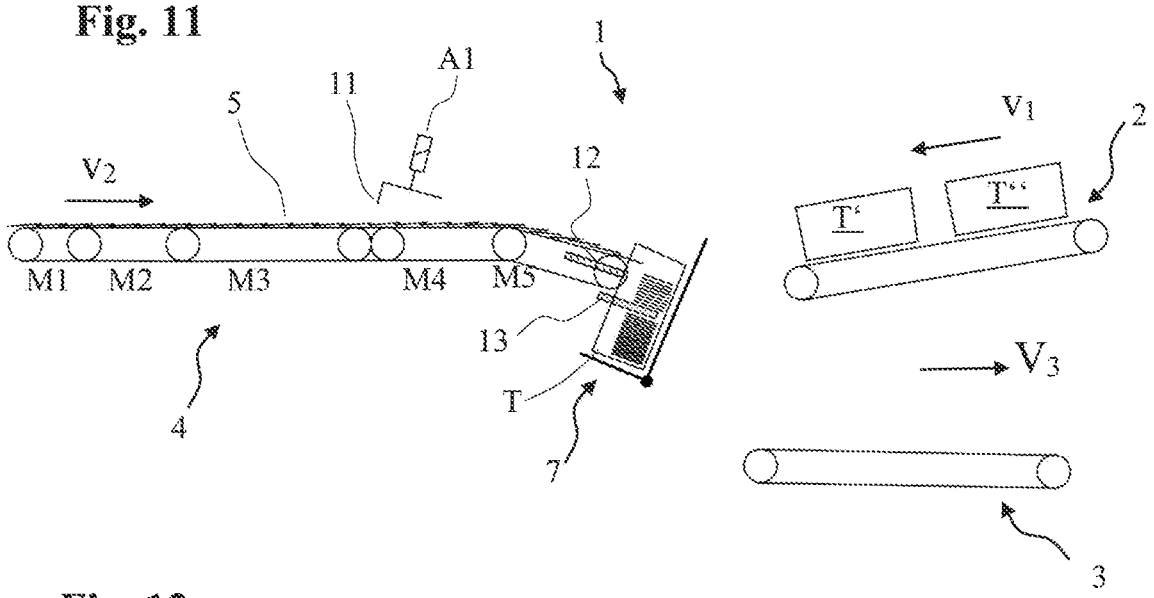

As shown in FIG. 10, the second compression element 13 attached to the receiving device 6 is then introduced into the transport container T, and the first compression element 12 subsequently is removed therefrom. The second compression element 13 introduced into the transport container T ensures that the compression of the stack S of flat objects 5 achieved by the first compression element 12 is upheld. Subsequently, or if necessary also during the described compression process, further flat objects 5 are inserted serially by the input device 4 into the transport container T, specifically on top of the stack S and above the second compression element 13, as shown in FIG. 10. The container receiving means 7 is then moved again—together with the second compression element 12—downwards in the direction of the lower input position, shown in FIG. 11, in order to obtain an optimal input or placement of further flat objects 5 on the stack S placed in the transport container T. Contrary to the illustration in the figures, the first and in particular the second compression elements 12, 13 are preferably designed as thin as possible, for example as thin metal sheets or thin tines of a rake, in order to cause an optimized stacking under an optimal use of the receiving contingent of the transport container T.

Figure 12:
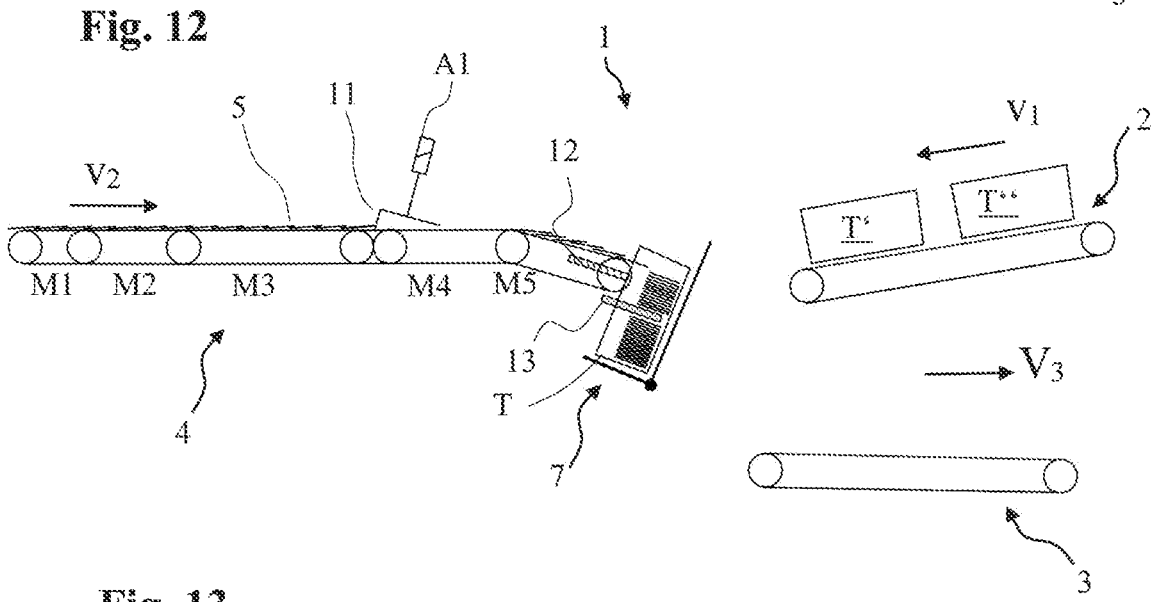
Figure 13:
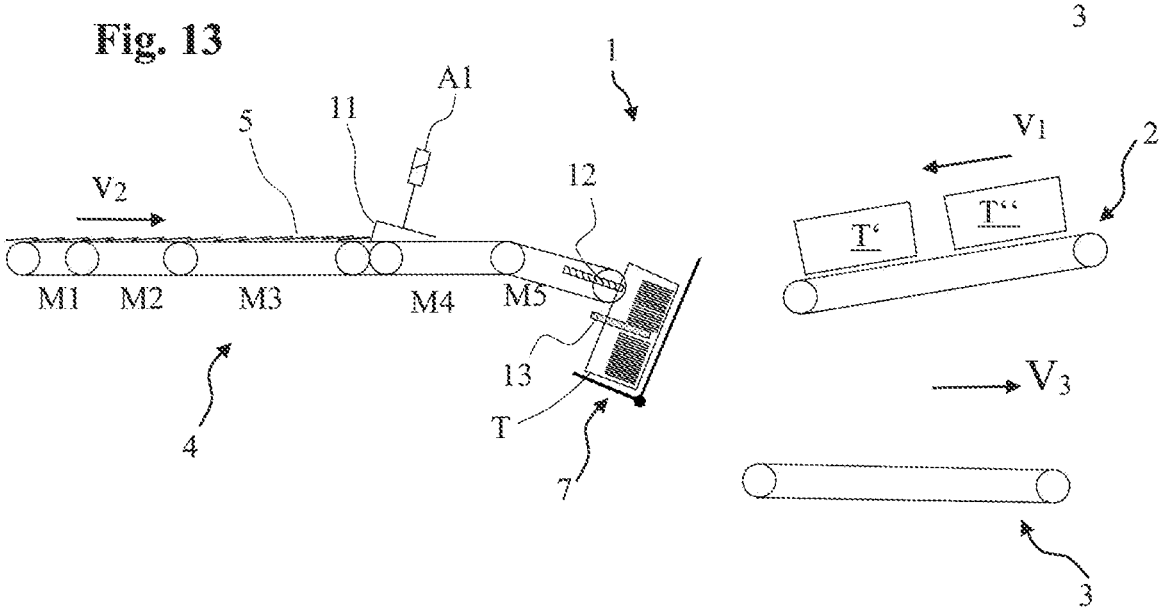

Shortly before a transport container T reaches a predetermined (or maximum) filling level, as shown in FIG. 12, the restraining element 11 is moved downward by the first actuator A1 into a blocking position. Thereby, the serial flow of flat objects 5 conveyed by the input device 4 to the transport container T is interrupted. The flat objects 5 which are on the fourth and fifth conveying sections M4, M5 (so downstream of the restraining element 11) are still fed into the transport container T, as shown in FIG. 13. Preferably, the conveying speed of the fourth and fifth conveying sections M4, M5 can be increased for a short time for this purpose, in order to shorten the duration of the required stopping of the serial flow of flat objects 5 arranged in upstream of the retaining element 11.

When none of the flat objects 5 is located on the downstream conveying sections M4 and M5 anymore, the downstream conveying sections M4, M5 can be stopped to save power. For the time that the restraining element 11 is in its blocking position, the conveying speed of the conveying sections M1 to M3 arranged upstream of the restraining element 11 can be reduced. Preferably, the speed at which the conveying sections M2 and M3 are driven preferably is gradually reduced, in particular in such a way that the conveying speed of the third conveying section M3 is lower than the conveying speed of the second conveying section M2. The first conveying section M1 can maintain its conveying speed, so that there is no effect on an infeed system arranged upstream of the input device 4, which serially feeds the series of flat objects 5 to the input device 4. Due to the retaining element 11 being in its lower blocking position and the described control of the conveying sections M1 to M3, an increasing scaling of the flat objects 5 arranged upstream of the retaining element 11 takes place, as indicated in FIGS. 12 to 16.

Figure 14:
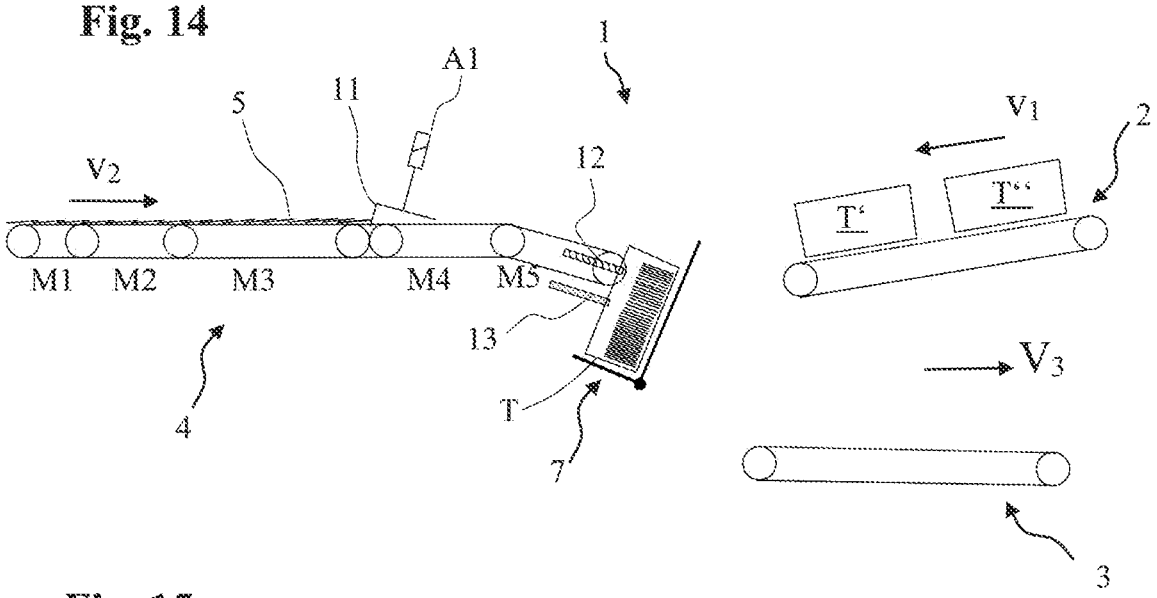
Figure 15:
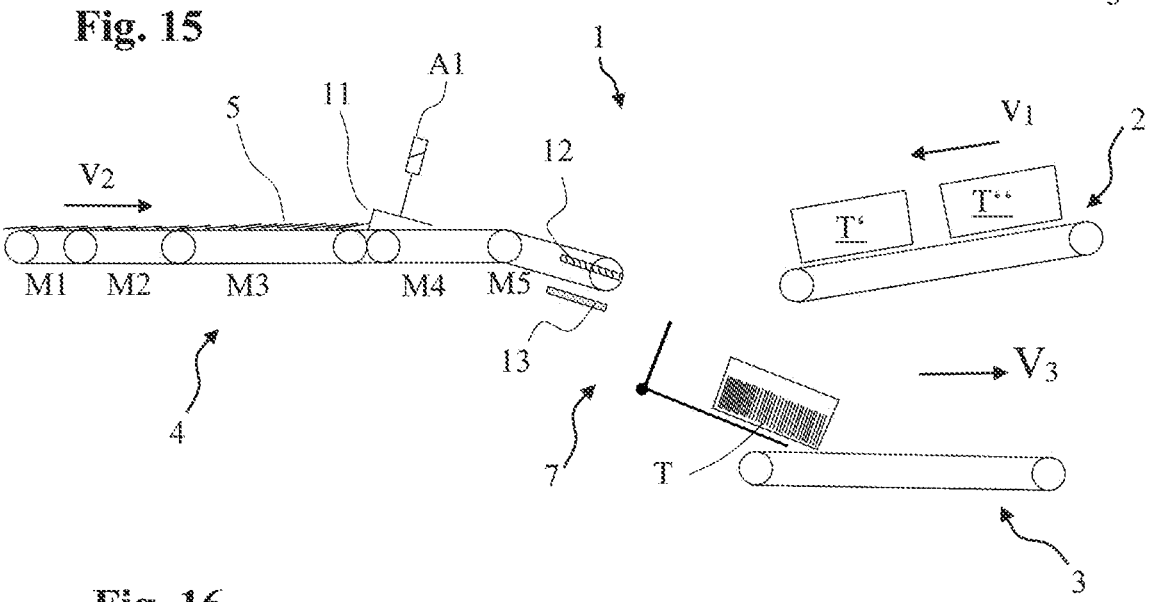
Figure 16:
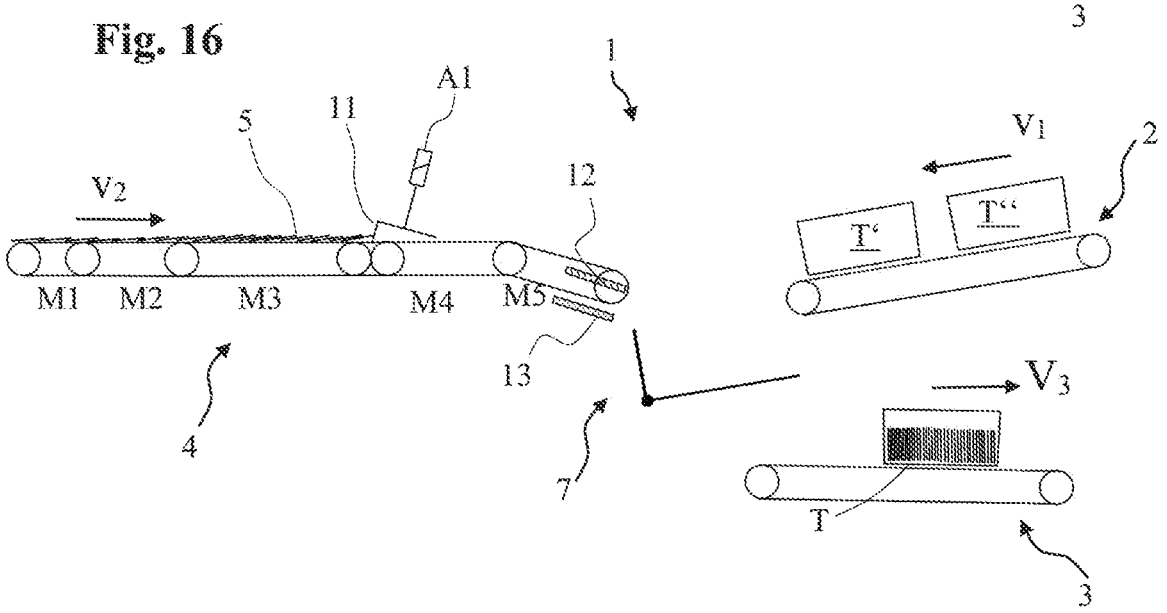

As soon as the transport container T is completely filled (particularly up to a maximum filling level), the second compression element 13 is moved out of the transport container T, as shown in FIG. 14, the container receiving means 7 is swiveled into the delivery position shown in FIG. 15 and the transport container T is delivered to the second transport device 3. Then, as shown in FIG. 16, the container receiving means 7 is moved back to the receiving position, shown in FIG. 2, to receive the next transport container T'. The filled transport container T meanwhile is transported away by the second transport device 3 along the third transport direction v3.

Figure 17:
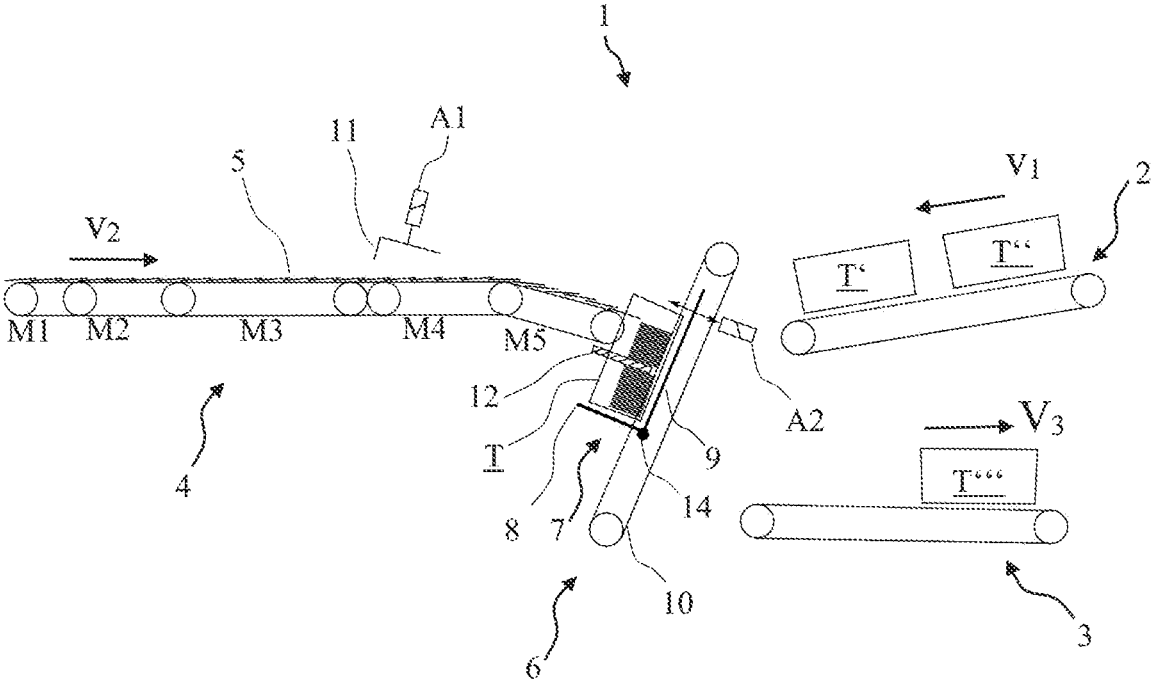
FIG. 17: Sketch of a second embodiment of a device for feeding flat objects into a transport container in a side view.

FIG. 17 sketches a second embodiment of a device 1 for feeding flat objects 5 into a transport container T in a side view. The embodiment shown in FIG. 17 corresponds to the embodiment shown in FIG. 1, but with only one compression element 12 instead of two. The single compression element 12 of this embodiment can be arranged on the input device 4 or on the receiving device 6. The compression element 12 hereby is insertable into the transport container T for compressing the stack of flat objects 5 inserted in the transport container T. Further, the compression element 12 is movable between an upper position and a lower position of the compression element, wherein the direction of movement is substantially along the vertical direction. In this case, the supply and removal of the transport containers T as well as the filling of the transport container T is carried out as described in FIGS. 2 to 16, with the exception of the step of compressing the stack of flat objects 5 inserted into the transport container T. The compressing can be performed here, for example, in such a way that the compression element 12 is retracted into the transport container T at a certain filling level and then moved downwards relative to the transport container T in the direction of the lower contact wall 8 (towards the top of the stack of flat objects). In an alternative embodiment, in the step of compression the single compression element 12 is retracted into the transport container T and subsequently the container receiving means 7 is moved upwards relative to the compression element 12, which is thus compressing the stack of flat objects as soon as the top of the stack is in abutment with the compression element 12 while the container receiving means 7 is further moved upwards. It is also conceivable that, for compression of the stack of flat objects, both a downward movement of the compression element 12 and an upward movement of the container receiving means 7 take place at the same time. After compression has been performed, the compression element 12 can be moved downward together or synchronously with the container receiving means 7 in the further course of the filling process for filling the transport container T with a plurality of flat objects. After filling the transport container T is finalized and preferably before the container receiving means 7 is pivoted into the delivery position, the compression element 12 is extended from the transport container T and moved back into an initial position.

Exemplary devices and an example of a method for feeding flat objects 5 in an upright position into a transport container T are described herein. However, the invention is not limited to the described embodiments. In particular, it is conceivable that the input device 4 may be controlled in a different manner. Further, it is also conceivable that a compression element is arranged on the container receiving device 6 in such a way that the compression element is pivoted together with the container receiving means 7 and, for example, is only brought out of the transport container receiving means 7 after the container receiving means 7 is in the delivery position. Further, the device can also have sensors for detecting the filling level. In addition, multiple compression and the use of more than two compression elements to be introduced successively into the transport container on the stack of flat objects stacked therein is also conceivable.

Figure 18:
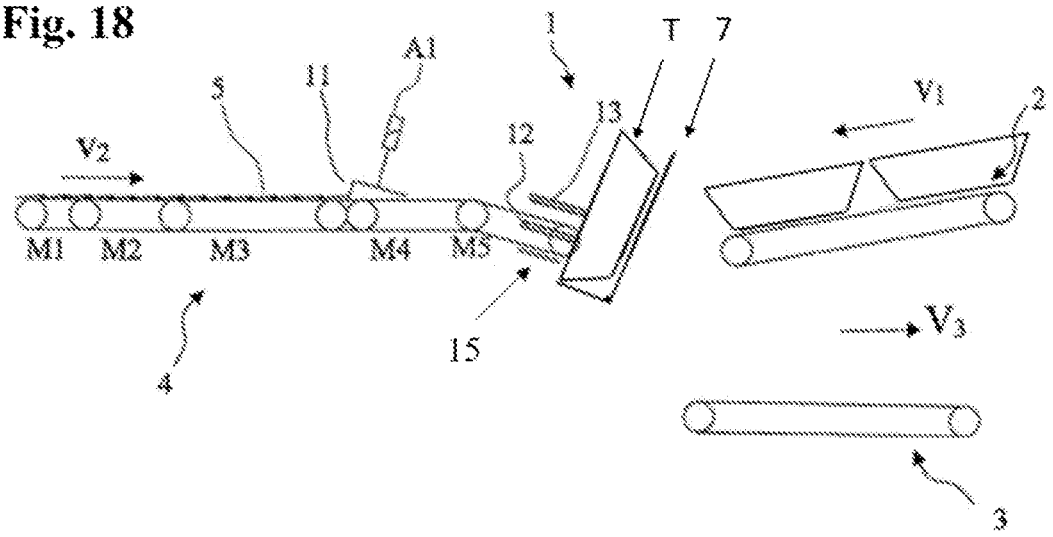
FIG. 18: Illustration of a preferred embodiment of the device with a movable base element that can be inserted into a transport container located in the device in an input position, wherein in the Figure the base element is located outside the transport container in an extended position.

FIGS. 18 and 19 show embodiments of the device with a movable base element 15 that can be inserted into a transport container T located in the receiving device 6 in an input position, wherein the base element 15 in FIGS. 18 and 19 is located outside the transport container T in an extended position. These embodiments of the device are specifically intended for use with transport containers T having inclined side walls, as shown in FIGS. 18 and 19. In the case of such transport containers T, in which at least two opposing side walls form an angle of more than 90° with the bottom of the transport container, there is a risk that a stack S of flat objects stacked in the transport container T, which is in the input position in the device, may slip out of the transport container due to the inclined side walls, in particular the front side wall of the transport container which is at the bottom in the input position. To prevent this, the movable base element 15 is retracted into the transport container T before flat objects 5 are inserted. In this position of the base element 15, which is shown schematically in FIGS. 20A and 20B, the base element 15 serves as a support, arranged at least substantially horizontally or preferably perpendicularly to the bottom of the transport container T, for supporting the stack S of flat objects stacked in the transport container T by serially feeding a plurality of flat objects 5 thereon.

In the embodiment shown in FIG. 18, the base element 15 is designed as a linearly movable plate which is coupled to a drive by means of which the plate of the base element 15 can be retracted into a transport container T located in the container receiving means 7 in the input position, and can be extended out of the transport container T. In the retracted position of the base element 15, shown in FIGS. 20A and 20B, the plate is in contact with and at least substantially perpendicular to the bottom of the transport container T. In this position of the base element 15, the flat objects 5 can be stacked on the plate of the base element 15, with the generated stack S of flat objects being supported on the one hand by the plate of the base element 15 and on the other hand by the (inclined) bottom of the transport container T. The stack S of flat objects thereby is supported by the plate of the base element 15. This prevents the stack S from slipping out of the transport container T during stacking.

In particular, when stacking of flat objects 5 with different thicknesses on a front side and a rear side, such as envelopes or mail items packed in an envelope, there is a risk of a stack formed by the (filled) envelopes being built up at an angle, if the items are always stacked in the same orientation on the stack S (i.e., for example, always with the thicker front side facing the bottom of the transport container T). This effect is shown schematically in FIG. 20A. As a result, there is a risk that the entire stack S or at least the upper layers of the stack will slip out of the transport container T during stacking, as indicated by an arrow in FIG. 20A. In order to prevent this, the inclination of the base element 15, in particular of the plate which can be moved into the transport container T, can preferably be adjusted relative to a horizontal plane. For this purpose, the plate is hinged to a frame of the base element 15 so as to be pivotable about a horizontal axis, for example. During stacking of the flat objects 5, the inclination of the plate of the base element 15 relative to the horizontal plane can thereby be adjusted so that the upper side of the stack S runs at least substantially horizontally or is inclined downwardly in the direction of the bottom of the transport container T, as shown in FIG. 20B, so that the flat objects 5 in the upper layers of the stack S cannot slip out.

FIG. 19 shows another embodiment of the device with a movable base element 15, wherein the base element 15 in this embodiment can be introduced into a transport container T located in an input position in the device by a pivoting movement. For this purpose, the base element 15 comprises at least one pivotable plate. Preferably, in this embodiment, the base element 15 comprises a first plate pivotally arranged laterally on a first side of the receiving device 6 and a second plate pivotally arranged laterally on a second side of the receiving device 6 opposite to the first side. The first and second plates are thereby coupled to a pivot drive, by means of which the two plates can be pivoted into and out of the transport container in a substantially horizontal plane or a plane which is perpendicular to the bottom of the transport container, as shown schematically in FIG. 19 by the arrow symbolizing the pivoting movement of one plate. When the two plates of the base element 15 are pivoted into the transport container T, the plates form a support for a stack S with a support surface formed by the top of the two plates, wherein the support surface is at least substantially perpendicular to the bottom of the transport container T (as shown in FIG. 20A). It is convenient that the inclination of the two plates with respect to a horizontal plane or with respect to the bottom of the transport container, as in the embodiment shown in FIG. 18, is adjustable by means of an inclination drive (as schematically shown in FIG. 20B). Instead of two plates, the base element 15 may also comprise only a single plate, which is pivotally attached to the side of the receiving device 6. However, the design of the base element 15 with two plates has the advantage that the extension of the device in a lateral direction (perpendicular to the transport directions v1, v2, v3) is smaller when the base element 15 is folded out, whereby the device is more compactly constructed.

The invention claimed is:

1. A device for feeding flat objects in an upright position into a transport container, the device comprising:

an input device configured for transporting flat objects and for inputting the flat objects into a transport container, a container receiving element configured for positioning the transport container in an input position for the inputting of the flat objects, wherein, in the input position, the transport container is arranged obliquely with respect to a horizontal plane and the flat objects are stacked in a stack on top of each other in the transport container during the inputting, and at least one compression unit arranged for compressing the stack of the flat objects in the transport container.

2. The device according to claim 1, wherein the at least one compression unit comprises at least one compression element configured for insertion into the transport container in at least one of during and after the inputting of the flat objects into the transport container.

3. The device according to claim 2, wherein the at least one compression element is movable between an upper position and a lower position.

4. The device according to claim 2, wherein the at least one compression unit further comprises a drive configured for moving the at least one compression element into or out of the transport container and within the transport container between an upper position and a lower position.

5. A method for feeding flat objects in an upright position into a transport container using the device of claim 2, the method comprising:

inputting flat objects into a transport container arranged in the container receiving element in the input position, stacking the flat objects in the transport container on top of each other thereby forming a stack of flat objects, and compressing the stack of flat objects formed in the transport container using the at least one compression element.

6. The method according to claim 5, further comprising removing the at least one compression element from the transport container after reaching a predetermined filling level of the transport container.

7. The method according to claim 5, wherein compressing the stack of flat objects comprises:

inserting a first compression element into the transport container above the stack of flat objects therein, moving the container receiving element upwardly, thereby compressing the stack of flat objects by abutting an upper surface of the stack of flat objects against the first compression element, inserting a second compression element onto the upper surface of the stack of flat objects, removing the first compression element from the transport container, inputting flat objects into the transport container using the input device and depositing the flat objects on the second compression element, and removing the second compression element upon reaching a predetermined filling level of the transport container.

8. The method according to claim 5, wherein compressing the stack of flat objects comprises:

moving, during or after the inputting, the at least one compression element into the transport container above the stack of flat objects and moving the at least one compression element from an upper position to a lower position, whereby the stack of flat objects is compressed by movement of the at least one compression element from the upper position to the lower position; or moving the container receiving element with the transport container disposed therein from a lower position to an upper position, whereby the stack of flat objects is compressed by movement of the container receiving element from the upper position to the lower position.

9. The method according to claim 8, further comprising moving a bottom member into a transport container arranged in the container receiving element and placing the flat objects on the bottom member for insertion into the transport container.

10. The device according to claim 1, wherein the container receiving element together with a transport container disposed therein is movable by a movement device between an upper input position and a lower input position.

11. The method according to claim 8, further comprising moving the container receiving element together with the transport container disposed therein from an upper input position to a lower input position at least one of before and after the compressing.

12. The device according to claim 1, wherein the at least one compression unit is arranged at or near the input device or at or near a receiving device comprising the container receiving element.

13. The device according to claim 1, comprising a first compression unit arranged at or near the input device, and a second compression unit arranged at or near a receiving device comprising the container receiving element.

14. The device according to claim 1, wherein, in the input position, an open side of the transport container faces in a direction of the input device and a bottom of the transport container encloses an angle smaller than 90° with the horizontal plane.

15. The device according to claim 1, wherein in the input position, the input device, at least partially engages the transport container arranged in the container receiving element.

16. The device according to claim 1, wherein the input device is configured for serially transporting a plurality of flat objects in a transport direction that lies at least substantially in the horizontal plane.

17. The device according to claim 1, wherein the input device comprises at least one conveyor device configured for serially transporting a plurality of flat objects in at least one of shingled and singled arrangement.

18. The device according to claim 1, wherein the container receiving element has a receptacle base, on which a bottom of the transport container can be arranged, and at least one lower contact wall, on which a first side wall of the transport container can be arranged in the input position.

19. The device according to claim 18, wherein the container receiving element further comprises at least one of a lateral abutment wall for guiding side walls of the transport container and a suction device arranged on the receptacle base, via which the transport container can be sucked in and fixed in the container receiving element.

20. The device according to claim 1, further comprising a movable bottom member configured for moving into a transport container located in the container receiving element, the movable bottom member configured as a support for flat objects inserted into the transport container when the movable bottom member is located in the transport container.

* * * * *